US006280542B1

(12) United States Patent
Cornelissen et al.

(10) Patent No.: US 6,280,542 B1
(45) Date of Patent: Aug. 28, 2001

(54) METHOD AND APPARATUS FOR THE MANUFACTURE OF A STEEL STRIP

(75) Inventors: Marcus Cornelis Maria Cornelissen, Castricum; Aldricus Maria Groot, Heerhugowaard; Huibert Willem Den Hartog, Noorwijkerhout, all of (NL)

(73) Assignee: Corus Technology BV, Ijmuiden (NL)

( * ) Notice: Subject to any disclaimer, the term of this patent is extended or adjusted under 35 U.S.C. 154(b) by 0 days.

(21) Appl. No.: 09/194,948

(22) PCT Filed: Jun. 9, 1997

(86) PCT No.: PCT/NL97/00325

§ 371 Date: Apr. 7, 1999

§ 102(e) Date: Apr. 7, 1999

(87) PCT Pub. No.: WO97/46332

PCT Pub. Date: Dec. 11, 1997

(30) Foreign Application Priority Data

Jun. 7, 1996 (NL) ..... 1003293

(51) Int. Cl.[7] ..... B21B 1/46; C21D 8/04

(52) U.S. Cl. ..... 148/541; 148/321; 164/417; 164/476; 266/103; 266/113

(58) Field of Search ..... 148/320, 541; 164/417, 476; 266/103, 113

(56) References Cited

U.S. PATENT DOCUMENTS

| | | | | |
|---|---|---|---|---|
| 4,885,041 | * | 12/1989 | Den Hartog et al. | 148/2 |
| 5,303,766 | | 4/1994 | Kreijger et al. | 164/476 |
| 5,528,816 | * | 6/1996 | Donini et al. | 29/527.7 |
| 5,611,232 | | 3/1997 | Rohde et al. | 72/202 |
| 5,634,257 | | 6/1997 | Kajiwara et al. | 29/527.7 |
| 5,634,513 | * | 6/1997 | Ishiguro et al. | 164/476 |
| 5,743,125 | | 4/1998 | Kneppe et al. | 72/201 |
| 5,802,902 | | 9/1998 | Rosenthal et al. | 72/201 |
| 5,810,069 | * | 9/1998 | Flick et al. | 164/476 |
| 5,832,985 | | 11/1998 | Pleschiutschnigg et al. | 164/4.76 |

FOREIGN PATENT DOCUMENTS

| | | |
|---|---|---|
| 19520832 | 4/1996 | (DE) . |
| 19538341 | 3/1997 | (DE) . |
| 19540978 | 5/1997 | (DE) . |

(List continued on next page.)

OTHER PUBLICATIONS

"Ferritic rolling of hot rolled sheet: Successful use of new technology could open doors" Iron and Steel Engineer, vol. 72, No. 8, Aug. 1995, Pittsburgh, PA, US.

"Le laminage a froid et le recuit des bandes a chaud ferritiques", Cahiers D'Informations Techniques De La Revue De Metallurgie, vol. 89, No. 5, May 1, 1992, Paris, France.

*Primary Examiner*—Roy King
*Assistant Examiner*—Nicole Coy
(74) *Attorney, Agent, or Firm*—Stevens, Davis, Miller & Mosher, LLP

(57) ABSTRACT

Method for the manufacture of a steel strip, wherein molten steel is cast into a slab, conveyed through a furnace, roughed in a roughing apparatus and finish-rolled in a finishing apparatus. The method comprises an endless or semi-endless process having either step a or step b, wherein a and b respectively comprise (a) manufacturing a ferritically rolled steel strip, wherein the slab is rolled in the roughing apparatus in the austenitic range and then cooled to a ferritic structure, and wherein the strip is rolled in the finishing apparatus at speeds essentially corresponding to the entry speed into the finishing apparatus, and (b) manufacturing an austenitically rolled steel strip, wherein the strip leaving the roughing apparatus is heated to the austenitic range and is rolled in the finishing apparatus and then cooled down to the ferritic range. In both step a and b, there is no material connection between the steel in the continuous casting machine and the steel being rolled in the finishing apparatus, and the strip is fed from the roughing apparatus to the finishing apparatus without intermediate storage. Additional steps include cutting the ferritically or austenitically rolled strip, after reaching the desired finished thickness, to portions of the desired length, and coiling the cut portions.

43 Claims, 1 Drawing Sheet

FOREIGN PATENT DOCUMENTS

Figure 1:
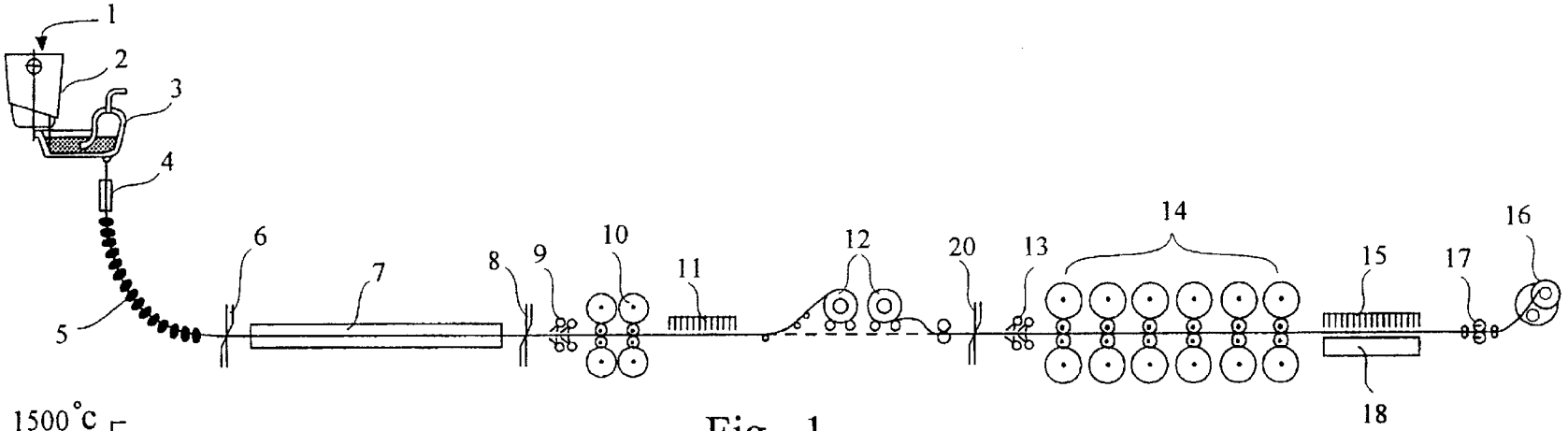

| | | |
|---|---|---|
| 19600990 | 7/1997 | (DE) . |
| 226446 | 6/1987 | (EP) . |
| 306076 | 3/1989 | (EP) . |
| 524162 | 1/1993 | (EP) . |
| 0761326 | 3/1997 | (EP) . |
| 0771596 | 5/1997 | (EP) . |
| 57145934 | 9/1982 | (JP) . |
| 58122107 | 7/1983 | (JP) . |
| 61204332 | 9/1986 | (JP) . |
| 62254954 | 6/1987 | (JP) . |
| 6471505 | 3/1989 | (JP) . |
| 01099719 | 4/1989 | (JP) . |
| 01254302 | 10/1989 | (JP) . |
| 364202 | 10/1991 | (JP) . |
| 4046601 | 2/1992 | (JP) . |
| 5104104 | 4/1993 | (JP) . |
| 6087004 | 3/1994 | (JP) . |
| 06320202 | 11/1994 | (JP) . |
| 07308701 | 11/1995 | (JP) . |
| 7214135 | 3/1997 | (JP) . |
| 9122709 | 5/1997 | (JP) . |
| 9164404 | 6/1997 | (JP) . |
| 09327702 | 12/1997 | (JP) . |
| 87549 | 10/1989 | (LU) . |
| 9612573 | 5/1996 | (WO) . |
| 9701401 | 1/1997 | (WO) . |

* cited by examiner

METHOD AND APPARATUS FOR THE MANUFACTURE OF A STEEL STRIP

The invention relates to a method for the manufacture of a steel strip, whereby molten steel is cast in a continuous casting machine into a slab and, while making use of the casting heat, is conveyed through a furnace apparatus, is roughed in a roughing apparatus, and finish-rolled in a finishing apparatus into a steel strip of a desired finished thickness, and to an apparatus for use therewith.

Such method is known from European patent application EP 0 666 122.

The invention is particularly suitable for application to a thin slab of a thickness less than 150 mm, preferably less than 100 mm, more preferably in a thickness range between 40 and 100 mm.

In EP-0 666 122 a method is disclosed whereby, following homogenisation in a tunnel furnace apparatus, a continuously cast thin steel slab is rolled in a number of hot-rolling steps, that is in the austenitic range, into a strip with a thickness less than 2 mm.

In order to achieve such a finished thickness with rolling apcaratuses and rolling trains which can be realized in practice, it is proposed to reheat the steel strip at least after the first mill stand, preferably by means of an induction furnace.

Located between the continuous casting machine and the tunnel furnace apparatus is a shearing apparatus with which the continuously cast thin slab can be cut into pieces of roughly equal length, which pieces are homogenized in the tunnel furnace apparatus at a temperature of approx. 1050° C. to 1150° C. After leaving the tunnel furnace apparatus the pieces can if desired be cut again into half slabs with a weight corresponding to the coil weight of the coil to be manufactured. Every half slab is rolled to a strip of the desired finished thickness and subsequently coiled by means of a coiling apparatus set up after the rolling apparatus.

EP-A-0 306 075 relates to a continuous process for the manufacture of a ferritically rolled steel strip and to an apparatus for performing the process. According to this publication a thin slab, thickness less than 100 mm, is cast in a continuous casting machine, hot rolled in the austenitic region, cooled into the ferritic region and subsequently coiled. In the method there is a continuous flow of steel from the continuous casting machine to the coiling apparatus for coiling the ferritically rolled steel strip.

DE-A-19 520 832 relates to a method and an apparatus for the manufacture of steel strip having as-cold-rolled properties. The object of the invention of DE-A-19 520 832 is to provide a method that does not require a reheating step in the austenitic region. DE-A-19 520 832 proposes to a single roughing step without reheating followed by cooling of the strip into the ferritic region and subsequent ferritic rolling in a temperature range of between 850 and 600° C. In the method of this publication, the steel strip is manufactured on a coil-by-coil basis. The object of the invention is to create a method of the known type which offers more possibilities, and moreover with which steel strip can be manufactured in a more efficient manner. To this end the method in accordance with the invention is characterized in that a. for the manufacture of a ferritically rolled steel strip, the slab is rolled in the roughing apparatus in the austenitic range and after the rolling in the austenitic range is cooled to a temperature whereby the steel has essentially a ferritic structure, and the strip, the slab or a part of the slab is rolled in the finishing apparatus at speeds essentially corresponding to the entry speed into the finishing apparatus and the subsequent thickness reductions and in at least one stand of the finishing apparatus is rolled in the ferritic range;

b. for the manufacture of an austenitically rolled steel strip, the strip leaving the roughing apparatus is heated to or held at a temperature in the austenitic range and is rolled in the finishing apparatus essentially in the austenitic range to the finished thickness and, following that rolling, is cooled down to a temperature in the ferritic range;

and the ferritically or austenitically rolled strip after reaching the desired finished thickness is cut to portions of the desired length which are subsequently coiled.

In this context a strip is taken to be a slab reduced in thickness, both before and after reaching the finished thickness.

Preferably the method is carried out as an endless or semi-endless process.

The invention is based on a plurality of new and inventive notions.

One new notion is that it is possible to apply the method with which according to known prior art only hot-rolled steel strip is manufactured, in such a way, that with it, besides an austenitically rolled steel strip, a ferritically rolled steel strip with the properties of a cold-rolled steel strip can also be obtained while making use of essentially the same means.

This opens up the possibility of manufacturing a wider range of steel strips in an apparatus of itself known more particularly of manufacturing with it steel strips which have a considerably higher added value on the market. In addition, as explained in the following, the method produces a particular advantage in the case of the rolling of a ferritic strip.

A second new notion is based on the insight that considerable advantages can be obtained with a method whereby not a coil-by-coil manner of manufacture is employed but whereby in a semi-endless or endless process one or more slabs are rolled into a strip of the desired finished thickness. A semi-endless process is to be understood as a process whereby from a single slab a plurality of coils, preferably more than three, more preferably more than five coils of usual coil dimension are rolled to the finished thickness in a continuous process in at least the finishing apparatus. In an endless rolling process slabs, or after the roughing apparatus, strips, are connected to each other such that in the finishing apparatus an endless rolling process can be performed whereby in the semi-endless and in the endless process there is no material connection between the steel in the continuous casting machine on the one hand and the steel being rolled in the finishing apparatus on the other hand.

The starting point for the conventional manner of manufacturing steel strip is a hot-rolled coil which is also manufactured with the known method in EP 0 666 112 by cutting a slab into portions of the desired coil weight. Normally this kind of hot-rolled coil has a weight of between 16 to 30 tonnes. This method of manufacture has a serious drawback. One drawback is that in the case of great width/thickness ratio of the steel strip obtained, the shape control, in other words the variation of thickness across the width of the strip, is very difficult to control. The shape control is in particular a problem when the strip runs in and out of the finishing apparatus. Because of the discontinuity in the material flow more in particular the associated discontinuity in the tension and the temperature variation in the strip, the head and tail of the hot-rolled steel to be rolled behave differently from the middle portion in the rolling apparatus. In practice advanced forward- and self-adapting control methods and numerical models are used to attempt to keep the head and the tail having a poor shape as short as possible. Despite these measures, a head and tail must still be rejected with each coil and this can mount up to several tens of meters in length in which the variation in thickness is a factor of four or more higher than the allowed value.

In the installations currently in use width/thickness ratio of the austenitically rolled strip of approximately 1200–1400 are considered to be the practically achievable maximum: any greater width/thickness ratio leads to a too long head and tail before a stable situation is reached, and so to high rejection.

On the other hand, because of the materials efficiency in processing both austenitically or hot-rolled and cold-rolled steel strip, there is a need for a greater width with an unchanged or decreasing thickness. Width/thickness ratios of 2000 or more are desired in the market, but for the reasons described, these are not practically achievable with the known method.

With the method in accordance with the invention it is possible to rough the steel strip, preferably from the furnace apparatus, in an uninterrupted or continuous process in the austenitic range, to roll in the finishing apparatus to the finished thickness and subsequently to cut in the shearing apparatus to strips of the desired length and coil these.

In the semi-endless process a slab of practical length is homogenised in the furnace apparatus and subsequently roughed from the furnace apparatus and finish-rolled wherein preferably no intermediate storage takes place but the slab is fed to the roughing mill and finish rolling mill and rolled.

The casting speed for slabs of the here conventional thicknesses is approximately 6 m/min. However, it is preferable to carry out at least the finish rolling at a rolling speed which is based upon a synthesised casting speed of approximately 12 m/min. This could be achieved by using a multi-strand casting machine or more casting machines. The simultaneously produced slabs can be joined together to form an endless slab. Another alternative is to rough the slabs then join them, possibly in combination with a coil-box for temporary storage. In both situations, it is possible to set up an endless rolling process in the finishing apparatus.

It is also possible to continuously fill the furnace .apparatus using multiple strands or more casting machines, and apply all the time a semi-endless process. It is of course also possible to manufacture coil by coil, by cutting short slabs, although this does not offer all the benefits of the semi-endless or endless method.

The semi-endless or endless process has a number of advantages.

In the known method, in which coil by coil is rolled, each strip which is coiled after rolling must be fed into the rolling mill. If a small finished thickness is required, the rolls rest on top of the other when feeding the strip into the rolling mill and the finished thickness is achieved by means of the elastic distortion of the rolls and the rolling mill. Besides the difficulty in controlling the finished thickness, the known method involves the additional drawbacks that the entry speed is low and that it is not possible to lubricate during rolling, as this reduces friction to such an extent that the rolls have no grip on the strip.

In an endless or semi-endless rolling process, a strip is fed in after which from that strip a number of coils are manufactured. It is now possible to feed in the strip once without lubrication, then lubricate during the rolling process. Lubricating during rolling has a number of advantages; less roll wear, reduced rolling forces, therefore smaller finished thicknesses, improved stress distribution throughout the cross-section of the strip, therefore better texture control.

In addition, endless or semi-endless rolling has the advantage of a greater achievable range of width-thickness ratios in the strip rolled to finished thickness, lower crown and higher exit speed of the strip after the last rolling pass.

Tests, simulations and mathematical models have shown that it is possible with this method to reach a width/thickness ratio of more than 1500, preferably more than 1800 and at sufficiently high rolling speed more than 2000 for austenitically and ferritically rolled material. Preferably a thin slab with a thickness between 40 and 100 mm when leaving the mould of the continuous casting machine is used. Preferably, among other things in connection with the greater freedom in the selection of the shape of the mould, and better control of the flow in the mould the slab is reduced in thickness after leaving the mould in a situation that the core is still liquid (liquid core reduction, LCR). The thickness reduction generally lies in .the range between 20 and 40%. The preferred thickness of the slab when entering the furnace apparatus lies in the range between 60 and 80 mm. It was shown that it is possible to roll a thin slab with a thickness in the range as mentioned before in the austenitic range to a final thickness of 0.6 mm or even less. At a slab or strip width of 1500 mm or more a width/thickness ratio of 2500 is therefore obtainable and with the state of the art.

It is obvious for the skilled person that also lower width/thickness ratios, but still higher than 1500 as possible with the state of the art, are obtainable.

The special feature of the present invention is not only that high width/thickness ratios are obtainable but that also much lower finished thicknesses in the austenitic range are possible than was considered possible and practically achievable.

When rolling austenitically, also called hot rolling, it is strictly pursued to prevent rolling in a temperature range where austenitic and ferritic material are present simultaneously because in this so-called two phase region the structure of the material is not predictable. An important reason for this is that at lowering the temperature from a temperature of ca. 910° C. the percentage austenitic material decreases very rapidly. Dependent on the percentage carbon, at about 850° C. more than 80% of the steel has transformed into ferrite.

When rolling in the two phase region, i.e. the temperature region that mainly extends between 850 and 920° C., the percentage of austenite and ferrite is not distributed homogeneously due to the unavoidable inhomogeneity of the temperature across the cross section of the strip. Because the transformation from austenite to ferrite is associated with temperature effects, volume effects and formability effects, an inhomogeneous austenite-ferrite distribution means a very difficult controllable shape and structure of the strip. To avoid rolling in the two phase region it is common practise not to roll in the austenitic range to thicknesses less than 1.5 mm in exceptional cases not less than 1.2 mm. The process of semi-endless or endless rolling opens the way to obtaining smaller thicknesses up to 0.6 mm in the austenitic range. Preferably a thin slab having a thickness within the range mentioned before is used. It is practical to homogenise the slab in the furnace apparatus to a temperature in the region between 1050 and 1200° C. preferably between 1100 and 1200° C. at about 1150° C. Due to the endless or semi-endless process the strip is continuously guided in the installation, even preferably directly before and after the shearing apparatus that cuts the strip in portions of desired length. Therefore it is possible to maintain a high rolling speed without the danger that the strip becomes uncontrollable due to aerodynamic effects. It has shown that final thicknesses in the austenitic area of 0.6–0.7 mm are well achievable at exit speeds from the last rolling stand of the finish rolling mill of less than 25 m/sec. Dependent on the number of mill stands in the finish rolling mill and the composition of the steel these values are also obtainable at exit speeds of 20 in/sec.

The method according to the invention very effectively uses the fact that a thin slab is used. In the conventional hot rolling a slab of about 250 mm thickness is used. Such slab has an edge region of about 100 mm width at both edges of the slab, in which a temperature drop of about 50° C. occurs, that means that considerably wide edge regions are considerably colder than the mid portion. Austenitic rolling of such slab can only take place until these edge regions enter the two phase austenitic ferritic range. In thin slabs these edge regions are considerably smaller, a few millimeters and the temperature drop in these edge regions is also considerably lower (a few degrees, 5 to 10° C). When rolling austenitically starting from thin slabs, a considerably larger austenitic working area is obtained.

The method according to the invention has also an advantage that is connected to the shape. For good guidance of the strip through the various millstands the strip has a so called crown i.e. a slightly thicker middle portion of the strip. To prevent distortions in the length direction the crown should have a constant value during the rolling process. At reducing thickness this means that the relative value of the crown increases. Such high relative crown is undesired. On the other hand a guidance of the sides of the strip is impossible at small thicknesses of the strip.

In the method according to the invention the strip is continuously guided up to the coiling apparatus so that guidance of the sides is not necessary and a lower crown is sufficient.

The method according to the invention yields a steel strip with a new combination of structure (austenitically rolled to finished thickness) and finished thickness (less than 1.2 preferably less than 0.9 mm). Such steel strips has new applications.

Until now it is common practise that for applications of the steel strip with a thickness less than 1.2 mm an austenitically rolled strip is cold rolled to the finished thickness also in those cases were the surface quality and formability obtainable with cold rolling are not required.

Examples of such applications are steel components that require only limited formability and/or surface quality such as radiators for central heating, inner parts of cars, panels for the building industry, drums and tubes.

The method according to the invention therefore yields a new steel quality with applications in areas where until now the much more expensive cold rolled steel was used.

Another advantage of the method according to the invention is that it is suitable for the manufacture of high strength steel of a thickness that was until now not achievable in a direct manner such as for example is requested in the automotive industry. For the manufacture of high strength steel with low thicknesses it is known to roll an austenitic steel strip, subsequently to cold roll this strip to the desired thickness and then obtain the desired strength properties by re-heating the strip to the austenitic range followed by controlled cooling to obtain the desired strength properties.

With the method according to the invention it is possible to make high strength steel of desired thickness in a direct manner. As mentioned before the thin slab has a very homogeneous temperature distribution that makes it possible on the one hand to obtain very low finished thicknesses and on the other hand makes it possible to roll in the two-phase region at a homogeneous structure. The result is that even in the two-phase region a homogeneous and controllable structure can be achieved at low thicknesses. By selection of rolling temperature and rolling reductions in connection with the composition of the steel (precipitation forming elements) and the cooling the desired high strength steel can be manufactured in a cheap and effective way. It is so possible to manufacture high strength steels of normal thicknesses in a direct manner. Such thin high strength steels are of particular importance for the automotive industry were the need exists for strong but light constructions in relation to safety and energy consumption. This also opens the way to the use of new frame constructions for automobiles. Examples of such high strength steels are the so-called dual-phase steels and TRIP-steels of which the composition and properties are deemed to be incorporated herein by this reference. In the manufacture of high strength steels with small thickness therefore rolling is so performed in the two-phase region. This method is an embodiment of the invention and is deemed to be comprised by step b.

A larger working region in relation to homogenising temperature, rolling speed and exit temperature from the finish rolling mill is obtained in an embodiment of the method according to the invention in which at least one reduction step is performed in the ferritic range.

By ferritic range in this connection is meant a temperature region in which at least 75% and preferably at least 90% of the material has a ferritic structure. It is preferred to avoid the temperature region wherein the two phases are present simultaneously. On the other hand it is preferred to perform the ferritic rolling steps at such high temperature that after coiling the steel recrystallises on the coil. For low carbon steel having a carbon content higher than about 0.03% the coiling temperature lies in a region between 650 and 720° C., for ultra low carbon steel having a carbon content less than 0.01% a coiling temperature in the region between 650 and 770° C. is preferred. Such ferritically rolled steel strip is suitable as replacement for conventional cold rolled steel strip or as starting material for further cold rolling in a known manner and for known applications.

In the case of low-carbon steel, a ferritic rolling stage produces a steel strip which, when recrystallised on the coil, has a course grain structure and therefore a relatively low yield point. Such a strip is highly suitable for further processing by means of conventional cold rolling processes. Provided it is thin enough, the strip is also suitable to replace cold-rolled strip for a great number of existing applications.

The advantage of using ultra-low-carbon steel (carbon content <approx. 0.01%) is that it has a low resistance to deformation at high temperature in the ferritic range. In addition, this type of steel offers the possibility of single-phase ferritic rolling in a wide temperature range. Therefore, the process described by the invention can be very advantageous when applied to ultra-low-carbon steel, to produce a steel strip with good deformation properties.

The obtained strip can be further processed in the conventional manner, such as pickling, possibly cold-rolling, annealing, or provided with a metallic coating and the temper-rolled. Also coating with an organic coating is also possible.

The semi-endless or endless method according to the invention provides the possibility of using a simple installation to carry out a number of processes which deliver steel strips with new properties, depending on the temperature and rolling regimes selected. It is possible to roll a strip austenitically, austenitically-ferritically in the dual-phase range or basically in the ferritic range. With regard to temperature, these ranges almost link up with each other, however, rolling in these ranges produces a strip with various different applications.

The method according to the invention has particular advantages when applied in an endless embodiment. In the semi-endless embodiment slabs of practical length are rolled. The reason for this is that with the presently available continuous casting machines the mass flow is not sufficient for the mass flow desired in the rolling process.

For controlling the flow in the mould among other things to increase the internal cleanliness and the quality of the surface it is possible to use a two or more pole EMBR. Control of the flow in the mould is also possible with the same benefits by using a vacuum tundish whether or not in combination with an EMBR as mentioned before.

An additional advantage of the use of an EMBR and/or a vacuum-tundish is that higher casting speeds are achievable herewith.

It appears that for the strip shape control a far more simple, feed-back control is adequate.

It is preferred that in step a, after leaving the finishing apparatus, the ferritic strip is coiled in the processing apparatus into a coil at a coiling temperature of over 650° C. The steel can then recrystallize on the coil; this makes an extra recrystallisation step superfluous.

A general problem with austenitic and ferritic rolling of steel is the temperature control of the steel in combination with the number of rolling steps and the reduction per rolling step.

The proposed process achieves the advantage that, if the transfer thickness from the austenitic range to the ferritic range is suitably selected, undesired rolling is avoided in the so-called two-phase region in which austenitic material transfers into ferritic material and austenitic and ferritic material exists simultaneously.

With an appropriate selection of the homogenizing temperature in the furnace apparatus, the reduction stages and the rolling speeds, it is possible to achieve the desired total reduction without the steel going below the transition temperature. This is the more important because, at high temperatures that is at cooling from the austenitic range, the austenite percentage is much more dependent on the temperature than if temperatures are low in the vicinity of the transition towards fully ferritic material.

This makes it possible to start in the finishing process the ferritic reduction at a temperature which is relative far above the transition temperature whereby hundred percent ferrite is present because then only a small quantity of austenite is present which is not detrimental to the ultimate product properties. In addition, the quantity of ferritic in this temperature range is only to a limited extend dependent on the temperature. In full austenitic rolling it is basically aimed at to keep the steel above a minimum temperature. In selecting one or more reduction stages in the ferritic range, the requirement is only not to exceed a certain maximum temperature. Such requirement is in general easier to fulfil.

This also achieves the effect that, in spite of the reduction to be realized in the ferritic range, the temperature during the whole ferritic rolling process can be held above or in the vicinity of the temperature whereby spontaneous recrystallization takes place on the coil. In practice it is possible, despite a transition temperature of 723° C. with certain high carbon contents to begin the finishing process for ferritic rolling at a temperature of approximately 750° C. and up to 800° C. or even up to 850° C. in cases where high austenite concentrations are admissible, for example 10%.

An even greater degree of freedom, if so desired in combination with the measure just cited, is attained when the steel grade is ULC or ELC, which steel grades possess a carbon concentration of less than approximately 0.04% carbon.

A preferred embodiment of the method in accordance with the invention which offers more possibilities for selecting rolling parameters in the ferritic range is characterized in that, after leaving the finishing apparatus and before being coiled, if that takes place, the ferritic steel strip is heated to a temperature above the recrystallization temperature and preferably in that the heating is carried out by generating an electrical current in the strip, preferably in an induction furnace. By heating the strip after leaving the finishing apparatus to a desired temperature, preferably above the recrystallization temperature, a greater fall in temperature is admissible during finishing. Consequently a greater freedom is also attained in selecting input temperature, rolling reduction per rolling pass, number of rolling passes and any possible additional process steps.

Particularly with steel below the Curie point and with normal finished thicknesses of between 2.0 and 0.5 mm, inductive heating is an especially suitable process that can be carried out with generally available means.

A further particular advantage of this embodiment is connected with the casting speed of the present generation of industrially available continuous casting machines for thin slab casting for steel. Such continuous casting machines have a casting speed, that is the speed at which the cast slab leaves the continuous casting machine, of approximately 6 m/min for a slab thickness thinner than 150 mm, but in particular thinner than 100 mm. Under known prior art this speed causes problems in manufacturing, without extra measures, a ferritic strip in a fully continuous process in accordance with the invention. The method named earlier whereby the steel strip is heated following finishing makes it possible to accept a larger temperature drop in the finishing apparatus and thus to roll at a slower entry speed. This preferred embodiment opens up the way to a fully continuous operation, even for use with the presently available continuous casting machines.

Model trials and mathematical models have shown that, with casting speeds of approximately 8 m/min. or more, a fully continuous operation for rolling the ferritic strip is possible. In principle, it ought then to be possible to omit any additional heating following finishing. However, as already described, in order to retain a greater freedom in selecting rolling parameters, it can also be desirable to apply such a heating step, in particular also for edge heating of the edges of the strip.

Particularly in the case of applying the method for manufacturing a ferritic strip, in the case of a difference between the casting speed and the desired rolling speed in the finishing rolls, while taking account of the thickness reduction, it is preferred to cut the cast slab into pieces of the greatest possible length.

This length will be restricted at the upper side by the distance between the exit side of the continuous casting machine and the entry side of the first mill stand of the roughing apparatus. By enabling temperature homogenization of the cast slab, in such cases the slab will in practice be cut into pieces of approximately the same length as the length of the furnace apparatus. With a practical installation this means pieces of a length of approximately 200 m from which about five to six coils of strip of normal dimensions can be manufactured in a continuous process, also referred to here as a semi-endless process.

A particularly suitable method for this is to fill the furnace apparatus with cast slabs or parts of slabs, whether or not pre-reduced in thickness. The furnace apparatus then functions as a buffer for a stock of slabs, parts of slabs or strips, each of which can then be semi-endlessly austenitically rolled and if desired subsequently ferritically rolled without the stated head and tail losses occurring.

In order to obtain pieces of the desired length, a shearing apparatus, known per se placed between the continuous casting machine and the furnace apparatus is used.

To improve the homogeneity of the cast slab and to harmonize the higher rolling speed of the roughing apparatus and/or the finishing apparatus with the capacity of the continuous casting machine, it is preferred that in step a the slab or parts of the slab are fed into the furnace apparatus at a slower speed than extracted from the furnace apparatus.

In the event that an austenitically rolled, or hot-rolled steel strip is manufactured in accordance with step b as named above, the strip must be rolled in the finishing apparatus essentially in the austenitic range. As stated earlier, during cooling from the austenitic range at relative low temperature differences, considerable quantities of ferrite do occur. In order to prevent too great a cooling and thus also too great a formation of ferrite, it is preferred that in step b following roughing to hold the temperature of the strip or to heat the strip by applying a thermal apparatus such as a second furnace apparatus, and/or one or more heat shields and/or coils boxes, whether or not provided with means of retaining heat or means of heating.

The thermal apparatus may be placed above or below the path of the steel strip or be otherwise removable from the path if it cannot stay in the path when not in use.

Model trials and mathematical models have shown that with the present prior art it is not technically possible to fully austenitically roll in a continuous process a steel, thin cast slab with a thickness of 150 mm or less, for example 100 mm or less, to a finished thickness of approximately 0.5 to 0.6 mm.

Accepting that circumstance, it is preferred to split the austenitic rolling process into a number of optimally selected consecutive and optimally harmonised sub processes.

This optimum harmonisation can be achieved with a further embodiment of the method in accordance with the invention which is characterized in that in step b the steel slab is roughed at a speed higher than corresponding to the casting speed, and more preferably in that the steel strip is finished at a speed higher than it is roughed.

To obtain a better surface quality it is preferred, at least in one of the steps a or b, before the steel strip enters the roughing apparatus, to remove from it a scale skin when present on it. This prevents any oxide present on the surface from being pressed into the surface during roughing, thereby causing surface defects. The normal manner of removing oxide using high pressure water jets may be applied without such leading to an undesirably great temperature loss of the steel slab.

To obtain a good surface quality it is preferred at least in one of the steps a or b before entering the finishing apparatus, for the steel strip to have removed from it any oxide scale present on it. By using for example high pressure water sprays this removes any oxide that may have formed. The cooling effect hereof does have an influence on the temperature but it remains within acceptable limits. If so desired, in the case of ferritic rolling, the strip can be reheated following finishing and before coiling.

A further preferred embodiment of the method in accordance with the invention is characterized in that lubrication-rolling is carried out in at least one of the mill stands of the finishing apparatus. This achieves the advantage of reducing the rolling forces, thereby enabling a higher reduction in the rolling pass involved, and the stress distribution and deformation distribution are improved across the cross-section of the steel strip.

The invention is also embodied in an apparatus for the manufacture of a steel strip, suitable for among other purposes carrying out the method in accordance with the invention comprising an apparatus for the manufacture of a steel strip, in particular suitable for carrying out a method in accordance with one of the preceding claims comprising a continuous casting machine for casting thin slabs, a furnace apparatus for homogenizing the cast slab, whether or not divided up, a roughing apparatus and a finishing apparatus.

Such an apparatus is likewise known from EP 0 666 122. To obtain more possibilities with the apparatus for selecting rolling parameters, the apparatus preferably has a reheating apparatus placed after the finishing apparatus, whereby more preferably the reheating apparatus is an induction furnace. This embodiment makes the whole process less dependent on the temperature variation in the rolling apparatuses and any inter disposed process steps.

In order, in the case of manufacturing an austenitic strip, to hold the strip during the entire rolling process essentially in the austenitic range, a specific embodiment of the apparatus is characterized in that a thermal apparatus is placed between the roughing apparatus and the finishing apparatus for keeping the strip at or heating it to a higher temperature.

With this embodiment, cooling between the roughing apparatus is avoided or lessened, or reheating can even take place.

The thermal apparatus can take the form of one or more heat shields, an insulated or heatable coiling apparatus or a furnace apparatus or a combination of these.

In order to be able to cool the austenitically rolled strip after the finishing apparatus to within the ferritic range, a further embodiment is characterized in that the reheating apparatus is removable from the path and is replaceable by a cooling apparatus for the forced cooling of an austenitically rolled strip. This embodiment achieves the effect that the total apparatus can be kept short. Preferably the cooling apparatus has a very high cooling capacity per unit of length so that the temperature drop while rolling ferritically is limited.

This embodiment is of particular importance in connection with a specific embodiment which is characterized in that as shortly as possible after the reheating apparatus, or after the cooling apparatus if present, a coiling apparatus is placed for coiling a ferritically rolled strip.

In order to be able to guide a wide, thin ferritic strip at high speed out of the finishing apparatus, to prevent material loss, and to improve the production capacity and production rate, it is important that the head of a ferritically rolled strip can be caught in a coiling apparatus and coiled up as shortly as possible after exiting.

The invention will now be illustrated by reference to a non-limitative embodiment according to the drawing.

Figure 2:
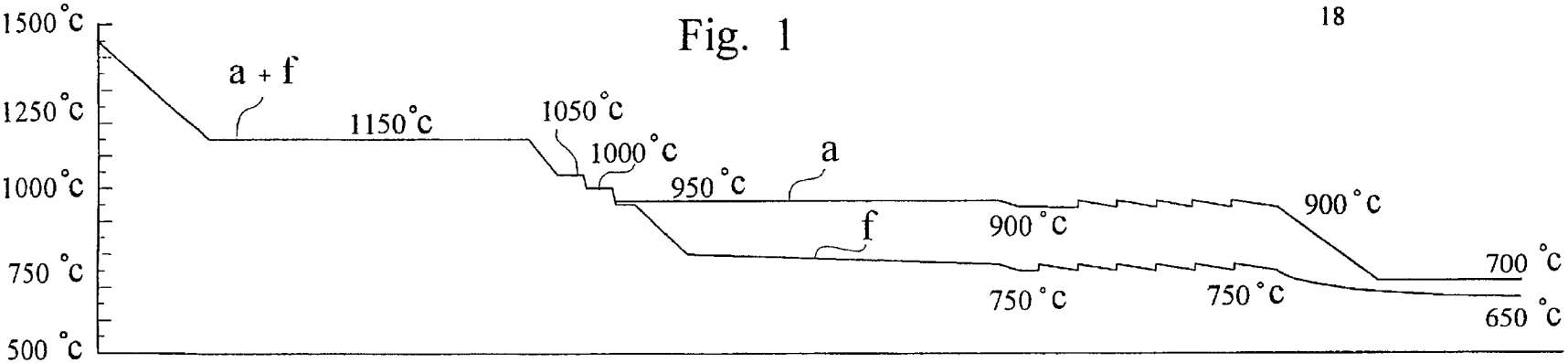
Figure 3:
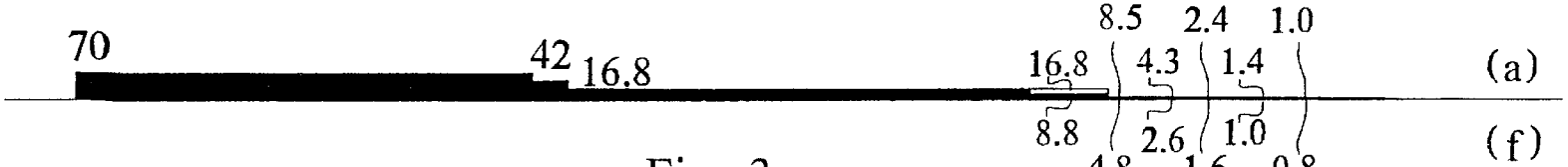

The drawing shows:

FIG. 1, a schematic side view of an apparatus in accordance with the invention;

FIG. 2, a graphic representation of the temperature variation in the steel as a function of the position of the apparatus;

FIG. 3, a graphic representation of the thickness variation of the steel as a function of the position of the apparatus.

In FIG. 1 reference number 1 indicates a continuous casting machine for casting thin slabs. In this description this is taken to mean a continuous casting machine suitable for casting thin slabs of steel with a thickness of less than 150 mm, preferably less than 100 mm. Reference number 2 indicates a casting ladle out of which the molten steel is to be cast is moved towards tundish 3 which in this embodiment takes the form of a vacuum tundish. Placed below this tundish 3 is a mould 4 into which the molten steel is cast and at least partially solidifies. If so desired mould 4 may be equipped with an electromagnetic brake. The vacuum tundish and the electromagnetic brake are not necessary and each of these is also separately useable and provide the possibility of attaining a higher casting speed and a better internal quality of the cast steel. The normal continuous casting machine has a casting speed of approximately 6 m/sec.; with extra means such as a vacuum tundish and/or an electromagnetic brake, casting speeds may be expected to reach 8 m/min or more. The solidified slab is fed into a tunnel furnace 7 with a length of for example 200–250 m. As soon as the cast slab reaches the end of the furnace 7 it is cut into slab parts by means of the shearing apparatus 6. Each slab part represents a quantity of steel corresponding to five to six conventional coils. In the furnace there is room for storing a number of such slab parts, for example three such slab parts. This achieves the effect that installation parts located after the furnace can continue to work while the casting ladle is being changed in the continuous casting machine, and casting a new slab has to start. At the same time storing in the furnace increases the time the slab parts stay in the furnace which also ensures a better temperature homogenization of the slab parts. The entry speed of the slab into the furnace corresponds to the casting speed and is therefore approximately 0.1 m/sec. Located after furnace 7 is an oxide removal apparatus 9, here in the form of high pressure jets having a pressure of about 400 atmosphere, for spraying off the oxide that has formed on the surface of the slab. The throughput speed of the slab through the oxide removal installation and the entry speed into the furnace apparatus 10 is approximately 0.15 m/sec. The rolling apparatus 10 which functions as roughing apparatus comprises two 4-high stands. If so desired in cases of emergency, a shearing apparatus 8 may be incorporated.

FIG. 2 shows that the temperature of the steel slab which has a value after leaving the tundish of approximately 1450° C. falls in the conveyer to below a level of approximately 1150° C., and is homogenized at that temperature in the furnace apparatus. The intensive spraying with water in the oxide removal apparatus 9 makes the temperature of the slab fall from approximately 1150° C. to approximately 1050° C. This applies to both the austenitic and the ferritic methods a and f respectively.

In the two mill stands of the roughing apparatus 10 the temperature of the slab falls in each roll pass by another approximately 50° C., so that the slab which originally had a thickness of approximately 70 mm is formed with an intermediate thickness of 42 mm into a steel strip with a thickness of approximately 16.8 mm at a temperature of approximately 950 ° C. The thickness variation as a function of the position is shown in FIG. 3. The figures indicate the thickness in mm. Incorporated after the roughing apparatus 10 is a cooling apparatus 11 and a set of coil-boxes 12, and if desired an additional furnace apparatus, not shown. In the case of the manufacture of an austenitically rolled strip, the strip leaving the rolling apparatus 10 may be stored temporarily and homogenized in the coil-boxes 12, and if an extra temperature increase is needed, it is heated in the heating apparatus, not shown, located after the coil-box. To the skilled person it will be evident that cooling apparatus 11, coil-boxes 12 and the furnace apparatus, not shown, may be in relative positions different to those just cited. As a consequence of the thickness reduction, the rolled strip leaves the coil-boxes at a speed of approximately 0.6 m/sec. Located after the cooling apparatus 11, coil-boxes 12 or furnace apparatus, not shown, is a second oxide removal installation 13 having a waterpressure of about 400 atmosphere for again removing any oxide scale which could have formed on the surface of the rolled strip. If so desired another shearing apparatus may be incorporated for cutting off the head and tail of the strip. Then the strip is fed into a rolling train which can take the form of six 4-high mill stands linked up one after the other. In the case of the manufacture of an austenitic strip, it is possible to attain the desired finished thickness of for example 0.6 mm by using only five mill stands. The thickness realized in each mill stand is, in the case of a slab thickness of 70 mm, indicated in the top row of figures in FIG. 3. After leaving the rolling train 14 the strip which now has a final temperature of approximately 900° C. with a thickness of 0.6 mm is intensively cooled by means of a cooling apparatus 15 and coiled onto a coiling apparatus 16. The entry speed into the coiling apparatus is approximately 13–25 m/sec. In the event that a ferritically rolled steel strip must be manufactured, the steel strip leaving the roughing apparatus 10 must be intensively cooled by means of cooling apparatus 11. This cooling apparatus can also be placed between mill stands of the finishing mill. Also use can be made of natural cooling whether or not between mill stands. Then the strip bypasses coil-boxes 12 and if so desired the furnace apparatus, not shown, and then has any oxide removed in oxide removal installation 13. The strip now in the ferritic range has a temperature of approximately 750° C. As indicated above, part of the material may still be austenitic but depending on the carbon content and the desired finished quality this is acceptable. In order to take the ferritic strip to the desired finished thickness of approximately 0.5 to 0.6 mm, all six stands of the rolling train 14 are used.

Preferably at least one mill stand of rolling train 14, more preferably the last mill stand has workrolls from high-speed-steel. Such workrolls have a high resistance to wear and therefore long working life at good surface quality of the rolled strip, a low coefficient of friction that contributes to a lowering of the rollforces and a high hardness. This last properly contributes to the fact that rolling at high rolling forces is possible so that lower finished thicknesses are obtainable. The workroll diameter is preferably circa 500 mm. As with the situation for rolling an austenitic strip, in the case of rolling a ferritic strip essentially the same reduction per mill stand is applied with the exception of the reduction by the last mill stand. This is all illustrated in the temperature variation according to FIG. 2 and the thickness variation according to the bottom row in FIG. 3 in the case of ferritic rolling of the steel strip as a function of the position. The temperature trend shows that, on exiting, the strip has a temperature well above the recrystallization temperature. In order to prevent oxide formation it can therefore be desired to cool the strip using cooling apparatus 15 down to the desired coiling temperature, whereby recrystallization can still occur. If the exit temperature from rolling train 14 is too low, then by means of a furnace apparatus 18 located after the rolling train, the ferritically rolled strip may be brought to a desired coiling temperature. Cooling apparatus 15 and furnace apparatus 18 may be positioned next to each another or after each other. It is also possible to substitute the one apparatus with the other apparatus to depend on the circumstance of whether manufacture is to be ferritic or austenitic. In the case of the manufacture of a ferritic strip, rolling is, as stated, endless. That is to say that the strip exiting the rolling apparatus 14 and possibly cooling apparatus 15 or furnace apparatus 18 has a greater length than normal for making one single coil and that slab part of a full furnace length or longer is continuously rolled. A shearing apparatus 17 is incorporated for cutting the strip into a desired length corresponding to normal coil dimensions. By suitably selecting the different components of the apparatus and the process steps carried out with them, such as homogenizing, rolling, cooling and temporarily storing, it has been found possible to operate this apparatus with one single continuous casting machine, whereby under known prior art, two continuous casting machines are used to harmonize the limited casting speed with the much higher rolling speeds normally applied. If so desired an extra so-called closed coiler may be incorporated directly after the rolling trains 14 to improve control of the strip travel and the strip temperature. The apparatus is suitable for strips with a width in the range between 1000 and 1500 mm with a thickness of an austenitically rolled strip of approximately 1.0 mm and a thickness of a ferritically rolled strip of approximately 0.5 to 0.6 mm. The homogenization time in the furnace apparatus 7 is approximately ten minutes for storing three slabs of the length of the furnace length. In the case of austenitic rolling the coil-box is suitable for storing two full strips.

The method and apparatus in accordance with the invention are particularly suitable for making thin austenitic strip, for example with a finished thickness less than 1.2 mm. Because of earforming by anistropy, such a strip is particulary suitable for further ferritic reduction for use as packaging steel in for example the beverage cans industry.

What is claimed is:

1. Method for the manufacture of a steel strip, wherein molten steel is cast in a continuous casting machine (5) into a slab and, while making use of the casting heat, is conveyed through a furnace apparatus (7), is roughed in a roughing apparatus (10), and finish-rolled in a finishing apparatus (14) into a steel strip of a desired finished thickness, the method comprising, in an endless or semi-endless process;

a manufacturing step selected from the group consisting of a and b, wherein a and b respectively comprise the following:

a. manufacturing a ferritically rolled steel strip, wherein the slab is rolled in the roughing apparatus (10) in the austenitic range and after the rolling in the austenitic range is cooled to a temperature such that the steel has essentially a ferritic structure, wherein the strip, the slab or a part of the slab is then rolled in the finishing apparatus (14) at speeds essentially corresponding to the entry speed into the finishing apparatus (14), wherein a subsequent thickness reduction in at least one stand of the finishing apparatus (14) occurs during rolling in the ferritic range, wherein there is no material connection between the steel in the continuous casting machine and the steel rolled in the finishing apparatus, and wherein the strip, the slab or a part of the slab is fed from the roughing apparatus to the finishing apparatus without intermediate storage, b. manufacturing an austenitically rolled steel strip, wherein the strip leaving the roughing apparatus (10) is heated to or held at a temperature in the austenitic range and is rolled in the finishing apparatus essentially in the austenitic range to the finished thickness and, following that rolling, is cooled down to a temperature in the ferritic range, wherein there is no material connection between the steel in the continuous casting machine and the steel being rolled in the finishing apparatus, and wherein the strip, the slab or a part of the slab is fed from the roughing apparatus to the finishing apparatus without intermediate storage;

cutting the ferritically or austenitically rolled strip, after reaching the desired finished thickness, to portions of the desired length; and subsequently coiling the cut portions.

2. Method according to claim 1, wherein step a, after leaving the finishing apparatus (14), the ferritic strip is wound in the processing apparatus (16) into a coil at a coiling temperature of over 650° C.

3. Method according to claim 1, wherein after leaving the finishing apparatus (14) and before being coiled, if that takes place, the ferritic steel strip is heated to a temperature above the recrystallization temperature.

4. Method according to claim 3, wherein the heating is carried out by generating an electrical current in the strip.

5. Method according to claim 1 wherein characterized in that before entering the roughing apparatus (10) the steel slab is cut into slab parts of approximately the same length as the effective length of the furnace apparatus (7).

6. Method according to claim 1 wherein characterized in that the slab or slab parts are fed into the furnace apparatus (7) at a slower speed than the speed at which the slab or slab part is extracted from the furnace apparatus (7).

7. Method according to claim 1, wherein roughing is followed by application of a thermal apparatus to maintain the strip at a temperature or heat it, wherein the thermal apparatus is selected from the group consisting of a second furnace apparatus, one or more heat shields, one or more coil boxes with or without means of retaining heat or means of heating, and combinations thereof.

8. Method according to claim 1 wherein the steel slab is roughed at a speed higher than corresponding to the casting speed.

9. Method according to claim 1 wherein at least one mill stand is provided with high-speed-steel workrolls.

10. Method according to claim 1 wherein the cast slabs or slab parts or pre-reduced slabs or slab parts are connected to each other and rolled to the finished thickness in an essentially continuous process.

11. Method according to claim 1 wherein at least during one of the steps a or b, before the steel strip enters the roughing apparatus (10), it has removed from it an oxide scale when present on it.

12. Method according to claim 1 wherein at least during one of the steps a or b, before the steel strip enters the finishing apparatus (14), it has removed from it an oxide scale when present on it.

13. Method according to claim 1, wherein lubrication-rolling is carried out in at least one of the mill stands of the finishing apparatus (14) or roughing apparatus (10).

14. Method according to claim 1, wherein the thin slab has a thickness of between 40 and 100 mm when leaving the mould (4).

15. Method according to claim 1 wherein the thin slab is reduced in thickness while the core of the slab is still liquid.

16. Method according to claim 15, wherein the thickness reduction while the core of the slab is still liquid lies in the range between 20 and 40.

17. Method according to claim 1 wherein the exit speed from the finishing apparatus (14) is less than 25 m/sec, preferably less than 20 m/sec.

18. Method according to claim 1 wherein the thin slab is homogenized in the furnace apparatus (7) to a temperature in the region between 1050 and 1200° C.

19. Method according to claim 1, wherein the width/thickness ratio of the ferritically or austenitically rolled strip is more than 1500.

20. Method according to claim 1 wherein in step a the ferritically rolled strip is coiled directly upon exiting the finishing apparatus (14).

21. Method according to claim 1 wherein the flow of the molten steel in the mould (4) is controlled by a two or more pole EMBR.

22. Method according to claim 1 wherein the flow of the molten steel in the mould is controlled by using a vacuum tundish (3).

23. Method according to claim 1 wherein characterized in that, in step b, the austenitically rolled strip leaving the finishing apparatus is intensively cooled before being coiled.

24. Method according to claim 1 wherein a high strength steel strip is manufactured by rolling in step b in the two-phase austenitic-ferritic region.

25. Method according to claim 23 wherein the rolling temperature and the rolling reductions in connection with the composition of the steel and the cooling are selected to form the high-strength steel strip.

26. Steel strip having a thickness less than 1.5 mm, a width/thickness ratio of more than 1400 and a crown with less than 40 $\mu$m.

27. Apparatus for the manufacture of a steel strip in accordance with claim 1 comprising a continuous casting machine for casting this slabs, a furnace apparatus (7) for homogenizing the cast slab, whether or not divided up, a roughing apparatus (10) and a finishing apparatus (14), comprising a reheating apparatus (18) placed after the finishing apparatus (14) which reheating apparatus (18) is removable form the path and is replaceable by a cooling apparatus (15) for the forced cooling of an austenitically rolled strip.

28. Apparatus according to claim 27, wherein the reheating apparatus (18) is an induction furnace.

29. Apparatus according to claim 27, characterized by a thermal apparatus (12) between the roughing apparatus and the finishing apparatus for keeping the strip at or heating it to a higher temperature.

30. Apparatus according to claim 27, wherein, as shortly as possible after the reheating apparatus (18), or after the cooling apparatus (15) if present, a coiling apparatus (16) is placed for coiling a ferritically rolled strip.

31. Apparatus for the manufacture of a steel strip, in accordance with claim 1 comprising a continuous casting machine for casting thin slabs, a furnace apparatus (7) for homogenizing the cast slab, whether or not divided up, a roughing apparatus (10) and a finishing apparatus (14), wherein behind the finishing apparatus and before the apparatus for coiling the strip a cooling apparatus (15) is set up suitable for intensively cooling a rolled strip.

32. Apparatus according to claim 31, wherein, as shortly as possible after the cooling apparatus a coiling apparatus (16) is set up suitable for coiling a ferritically rolled strip.

33. Apparatus according to claim 27 wherein, a shearing apparatus is provided after the finishing apparatus and before the apparatus for coiling the steel strip.

34. Apparatus according to claim 27 wherein, a close coiler (16) is set up directly aster tile finishing apparatus (14).

35. Apparatus according to claim 27 wherein, characterized in that, a cooling apparatus (11) is provided between the roughing apparatus and the finishing apparatus (14).

36. Apparatus according to claim 27, wherein, characterized in that, the mould (4) of the continuous casting machine is provided with an EMBR.

37. Apparatus according to claim 27 wherein, characterized in that, the continuous casting machine is provided with a vacuum tundish (3).

38. Apparatus of claim 27, further comprising a means for joining together slabs or slab parts.

39. Method of claim 1, wherein one slab results in a plurality of coils of steel strip.

40. Method of claim 1, wherein the steel for the coiled ferritically rolled strips and the steel for the coiled austenitically rolled strips pass through the same roughing apparatus and finishing apparatuses.

41. Method of claim 4, wherein the heating is carried out in an induction furnace by generating an electrical current in the strip.

42. Method of claim 19, wherein the width/thickness ratio of the ferritically or austenitically rolled strip is more than 1800.

43. Method of claim 42, wherein the width/thickness ratio of the ferritically or austenitically rolled strip is more than 2000.

* * * * *

UNITED STATES PATENT AND TRADEMARK OFFICE

CERTIFICATE OF CORRECTION

PATENT NO. : 6,280,542 B1 
DATED : August 28, 2001
INVENTOR(S) : Marcus Cornelis Maria Cornelissen et al.

It is certified that error appears in the above-identified patent and that said Letters Patent is hereby corrected as shown below:

Title page,
Item [73], the name of the Assignee is -- Corus Staal BV --

Column 5,
Line 9, change "20 in/sec." to -- 20 m/sec. --

Column 14,
Line 64, after "40" insert -- % --.

Column 16,
Line 18, change "aster tile" to -- after the --.

Signed and Sealed this

Twenty-first Day of January, 2003

JAMES E. ROGAN
*Director of the United States Patent and Trademark Office*